US006814247B2

(12) United States Patent
Matthias

(10) Patent No.: US 6,814,247 B2
(45) Date of Patent: Nov. 9, 2004

(54) FLUID DISPENSER FOR BABIES

(76) Inventor: Hugo Matthias, 201 St. Paul's Ave. Suite 4D, Jersey City, NJ (US) 07306

( * ) Notice: Subject to any disclaimer, the term of this patent is extended or adjusted under 35 U.S.C. 154(b) by 0 days.

(21) Appl. No.: 10/264,120

(22) Filed: Oct. 3, 2002

(65) Prior Publication Data

US 2004/0065634 A1 Apr. 8, 2004

(51) Int. Cl.[7] ..... A61J 9/00; A61J 9/06

(52) U.S. Cl. ..... 215/11.1; 215/11.6; 215/395; 248/105

(58) Field of Search ..... 215/11.1, 11.2, 215/11.6, 379, 395; D24/197–199; 248/105, 106, 102

(56) References Cited

U.S. PATENT DOCUMENTS

| | | | | | |
|---|---|---|---|---|---|
| 2,469,859 | A | * | 5/1949 | Charbeneau | 248/106 |
| 3,146,904 | A | * | 9/1964 | Hansen et al. | 215/11.1 |
| 4,637,934 | A | * | 1/1987 | White | 426/117 |
| 4,867,159 | A | | 9/1989 | Fulton | |
| 4,867,325 | A | * | 9/1989 | Dransfield | 215/11.2 |
| 4,898,060 | A | * | 2/1990 | To | 84/95.2 |
| 5,176,705 | A | | 1/1993 | Noble | |
| D353,675 | S | * | 12/1994 | Borneman | D24/199 |
| 5,704,505 | A | * | 1/1998 | Singh | 215/397 |
| D404,492 | S | * | 1/1999 | Demery | D24/197 |
| 6,138,848 | A | | 10/2000 | Fermo | |
| 6,244,452 | B1 | * | 6/2001 | Morano et al. | 215/11.6 |

FOREIGN PATENT DOCUMENTS

| | | | | |
|---|---|---|---|---|
| FR | 2568771 A1 | * | 2/1986 | 215/11.1 |
| GB | 624266 | * | 6/1949 | 215/11.1 |
| GB | 2139504 A | * | 11/1984 | 215/11.1 |
| GB | 21703410 A | * | 8/1986 | 215/11.1 |

* cited by examiner

*Primary Examiner*—Sue A. Weaver
(74) *Attorney, Agent, or Firm*—Jennifer Meredith; Meredith & Keyhani, PLLC

(57) ABSTRACT

The present invention provides a dispenser for feeding liquid to an infant. The dispenser may be comprised of a generally circular continuous ring container having an opening, outer diameter and inner bore, the inner bore being adapted for receiving a fluid. A nipple formed of compressible material, comprising a flexible tubular body having a tip end for insertion in the infant's mouth and a base end, the tip end having a nipple opening for flow of the liquid through the nipple from the container in response to the infant's sucking action on the tip end and base end being a radially enlarged flange for attaching nipple to opening of the container and a securing ring for attaching the nipple to the opening of the container. The dispenser may also have a stand or be self supporting.

1 Claim, 8 Drawing Sheets

FLUID DISPENSER FOR BABIES

BACKGROUND OF THE INVENTION

This invention relates to feeders and dispensers for fluids, and more particularly, but not by way of limitation, to an infant/child/baby bottle which may be reusable or disposable and serve as a shipping and storage container for liquids, soft food, formula, juices, frozen substances and the like to be consumed by infants/children/babies and a refillable storage container.

Baby bottles are well known in the art. Conventional baby bottles (also referred to herein as infant feeding systems or feeding systems) include a glass or plastic container having an externally threaded container opening, a bottle feeding nipple, and a screw-on top for securing the nipple to the container. Both the container and the nipple are reusable. A standard nipple, which is defined herein to mean a feeding nipple of the type commonly used with reusable baby bottles utilizing screw-on caps, is commonly made of either natural or synthetic rubber, both of which are flexible and compressible. Standard nipples are available for premature infants, newborns, and toddlers. An opening in the tip end (also referred to as the mouth portion) of the nipple permits liquid to be withdrawn from the container in response to a sucking action by the nursing infant. The size of the opening in the tip end of the nipple (also referred to as the nipple opening) varies. For a premature baby, the nipple opening is typically a small pinhole. For older infants and toddlers, the nipple opening is often in the form of a cross-cut or "X" to permit the infant to receive more liquid in response to the sucking action.

Care givers normally feed infants milk, formula, juices, and water from a baby bottle. In addition, some infants—especially older infants—receive dilute mixtures such as cereal-formula or thinned vegetables via baby bottle. As used herein, the terms "liquid" and "beverage" are used interchangeably to include all forms of nutrition capable of administration to infants through a nipple.

Not all baby bottles use rigid containers. In one baby bottle, a disposable container made of plastic film is deployed within a container shell. The opening of the disposable container folds across an end of the container shell and is secured by a flexible rubber nipple which clamps the disposable container in place. In this feeding system, the container is disposable but the nipple and shell are reusable.

Reusable baby bottles are major sources of concern for parents and other care givers. Bottle preparers must properly clean and sterilize baby bottles, bottle feeding nipples, and caps to prevent introduction of harmful contaminants into infant formula and other beverages to be consumed by the infant. The sterilization process is time consuming; moreover, the bottle preparer may fail to clean a reusable baby bottle thoroughly and thereby place the infant at risk.

Preparation of the beverage also presents risks. Formula and juices frequently require dilution of a concentrate using water. A simple mistake in understanding directions or in the measurement of the ingredients of an infant beverage may subject the infant to gastric distress or nutritional imbalances. Although some contaminants and bacteria are not harmful to adults, infants are especially sensitive because their systems have not yet fully developed. Dilution water, and ordinary tap water in particular, may contain trace amounts of minerals or bacteria which are harmful to infants. Chlorination of drinking water, although common throughout most of the United States, is not universal. Water systems in remote locations often lack the chlorine residual necessary to sanitize the water for drinking purposes. While the use of bottled water reduces the risk of contamination, bottle preparers may not seal the bottled water between uses.

Assuming the bottle preparer properly sterilizes bottle parts and correctly dilutes the concentrated infant beverage with suitable dilution water, reusable baby bottles present additional problems. The bottle preparer may incorrectly estimate the amount of formula a baby may need, resulting in wasted formula. Prepared baby bottles must be refrigerated prior to use, which in turn creates inconvenience and expense for transporting a baby bottle. Baby bottles also tend to leak through the nipples when the baby bottles are subjected to mechanical forces, causing clothes and other objects to be stained or damaged by the leaking beverage.

Users/preparers must periodically replace bottle feeding nipples, bottles, and caps. Many grocery stores and convenience stores which sell infant beverages do not sell the baby bottle parts. As such it would be desirable to provide a fluid dispenser that may incorporate the standard nipples that may be purchased in any convenience store.

There have long been devices for holding a nursing bottle while a child drinks from the bottle. These devices have generally been awkward, cumbersome structures, and may potentially endanger the child.

U.S. Pat. No. 4,405,106, issued to Adler, discloses a bottle support structure which is attached directly to the child. Adler teaches a baby bottle holder including a bottle clip extending laterally from an arm portion. The arm portion is pivotally connected to a mounting panel which rests on the chest of the child. The free end of the arm portion doubles back to fit into any one of several loops on the upper face of the panel, to secure the bottle at a desired angle relative to the panel and the child. Straps extend from opposing lateral edges of the panel for wrapping and fastening around the chest of the child. A problem with the '106 patent is that the straps could bind around and injure the child. Another problem with the '106 patent is that the device is too heavy and cumbersome for placement on the chest of a premature baby. Still another problem is that the straps wrap around the baby so that the baby would have to be either lifted or rolled on top of the straps to secure and remove the device from the baby. Finally, is needlessly complex.

Other prior patents disclose bottle propping devices which are secured to a child bed or seat. U.S. Pat. No. 1,863,163, issued to Malti, reveals a bottle support device including an arch member secured at each end to opposing sides of a crib. A bottle clip is mounted on a support arm secured with a thumb set screw to the arch member. A problem with the '163 patent is that the device can be used only when the child is in a crib and the crib must have a suitable width and rail construction. Another problem is that the device is too long to conveniently carry, such as in a purse. Still another problem is that the bottle does not follow the child as the child moves in the crib. Finally, the invention disclosed by the '163 patent would be relatively expensive to manufacture.

Martin, U.S. Pat. No. 3,289,986, issued on Dec. 6, 1966, discloses a holder for a nursing bottle and for other child items. Martin provides a bottle clip at one end of a flexible goose neck stem similar to those supporting bulbs and shades of some desk lamps. The other end of the goose neck stem is fastened onto one side of a child bed. A problem with Martin is that the child must be in a bed having a side rail suitable for holder engagement. And, once again, the Martin device does not cause the bottle to move with the child.

Many nursing bottles provide a gripping aid that only develops an infant's gross motor skills. However, a gripping aid that also aids fine motor skill development not only assists in the nursing process, but can also stimulate strength, dexterity and independence.

It is thus an object of the present invention to provide a fluid dispenser for babies which overcomes the problems inherent in the prior art. The fluid dispenser may be pre-filled and disposable or reusable, self supporting and serve as both a liquid dispenser and pacifier for a small child.

SUMMARY OF THE INVENTION

The present invention is directed to a dispenser for feeding liquids to an infant, child, babies, etc. One aspect of the invention is a dispenser for feeding liquid to an infant, comprising: a generally circular continuous ring container having an opening, outer diameter and inner bore, the inner bore being adapted for receiving a fluid therein; a nipple formed of compressible material, the nipple comprising: a flexible tubular body having a tip end for insertion in the infant's mouth and a base end, the tip end having a nipple opening for flow of the liquid through the nipple from the container in response to the infant's sucking action on the tip end and base end being a radially enlarged flange for attaching the nipple to the opening of the container; and a securing ring for attaching the nipple to the opening of the container.

According to another aspect of the present invention, a disposable pre-filled dispenser for feeding liquid to an infant is disclosed, comprising: an outer housing having a generally circular continuous ring shape with a outer diameter and an inner bore for containing food or beverage to be dispensed, an opening in a portion of the outer housing and continuing through the inner bore; a nipple formed of compressible material, the nipple comprising: a flexible tubular body having a tip end for insertion in the infant's mouth and a base end, the tip end having a nipple opening for flow of the liquid through the nipple from the dispenser in response to the infant's sucking action on the tip end; and a securing ring that is generally circular removably attached to and in communication with the opening and the nipple.

According to a further aspect of the present invention, a combination pacifier, teether and refillable baby bottle for feeding liquid to a nursing infant is disclosed, comprising: an outer housing having a generally circular continuous ring shape with an outer diameter and an inner bore for containing food or beverage to be dispensed; an opening formed in a portion of the outer housing and continuing through the inner bore, wherein the opening is formed by a protruding ring having an interior sidewall and an exterior threaded sidewall; a nipple formed of compressible material, the nipple comprising a flexible tubular body having a tip end for insertion in the infant's mouth and a base end, the tip end having a nipple opening for flow of the liquid through the nipple from the dispenser in response to the infant's sucking action on the tip end; a generally circular securing ring with an outer diameter and an inner threaded diameter, wherein the inner threaded diameter is in communication with the exterior threaded sidewall; the outer housing may be in sealed communication with the nipple by the securing ring, so that squeezing pressure exerted on the outer housing by an infant or child can force fluid contained in the inner bore to the nipple opening; and a stand with a u-shaped snap portion and a flat bottom portion, the u-shaped snap portion being removably attachable to a portion of the outer housing.

According to another embodiment, a self-supporting combination pacifier, teether and refillable baby bottle for feeding liquid to a nursing infant is disclosed, comprising: an outer housing comprised of a stand portion and a liquid portion, wherein the outer housing has a generally circular continuous ring shape when closed and the liquid portion has an outer diameter and an inner bore for containing food or beverage to be dispensed. The stand portion may be hingedly attached to the liquid portion so as to provide a self-supporting combination pacifier, teether and refillable baby bottle when in an open position; an opening formed in a portion of the liquid portion and continuing through the inner bore, wherein the opening is formed by a protruding ring having an interior sidewall and an exterior threaded sidewall; a nipple formed of compressible material, the nipple comprising a flexible tubular body having a tip end for insertion in the infant's mouth and a base end, the tip end having a nipple opening for flow of the liquid through the nipple from the liquid portion in response to the infant's sucking action on the tip end; and a generally circular securing ring with an outer diameter and an inner threaded diameter, wherein the inner threaded diameter is in communication with the exterior threaded sidewall.

These and other features, aspects and advantages of the present invention will become better understood with reference to the following drawings, description and claims.

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention, since the scope of the invention is best defined by the appended claims.

Figure 1A:
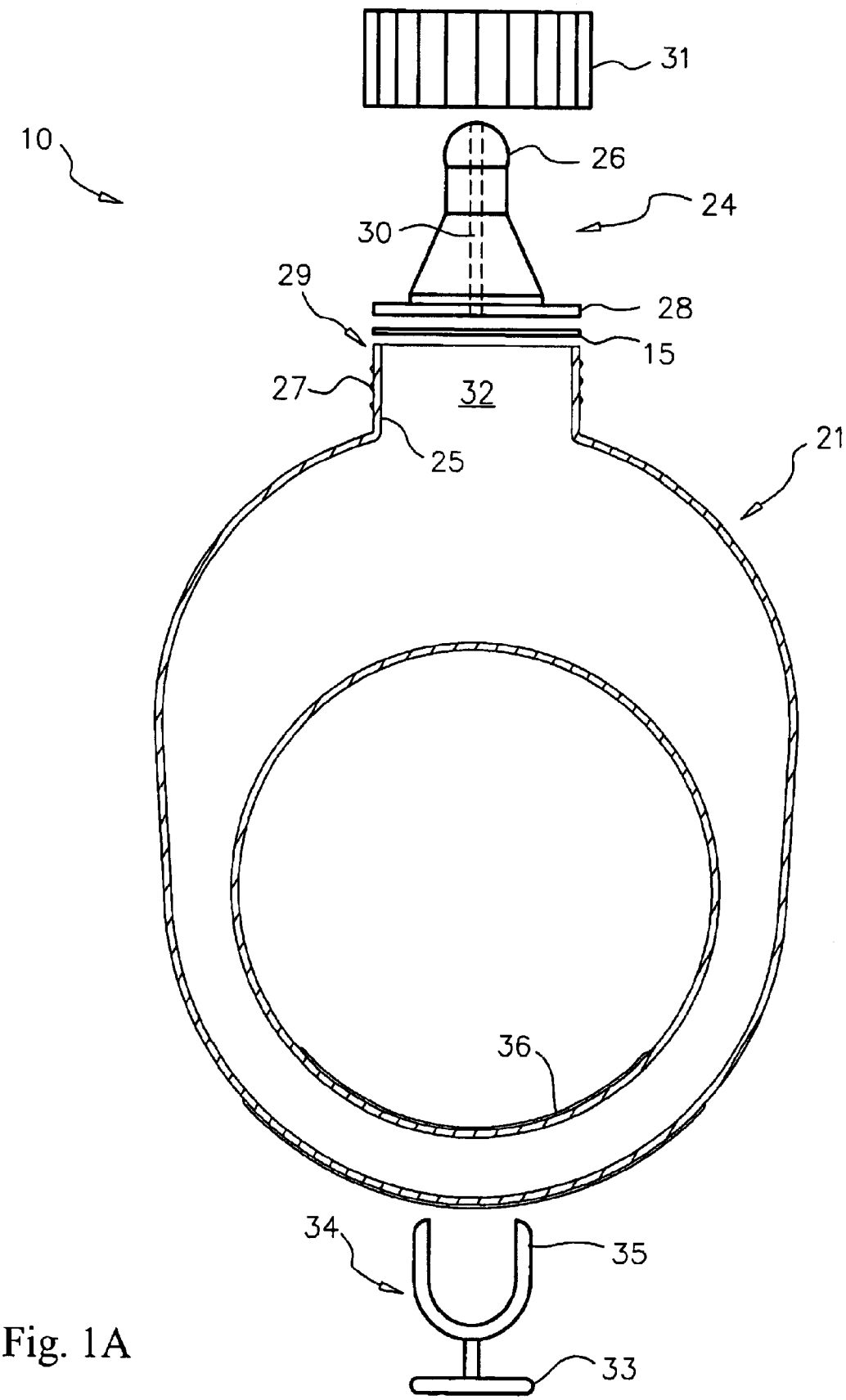
FIG. 1A is an exploded front view of a fluid dispenser as in the present invention.
Figure 1B:
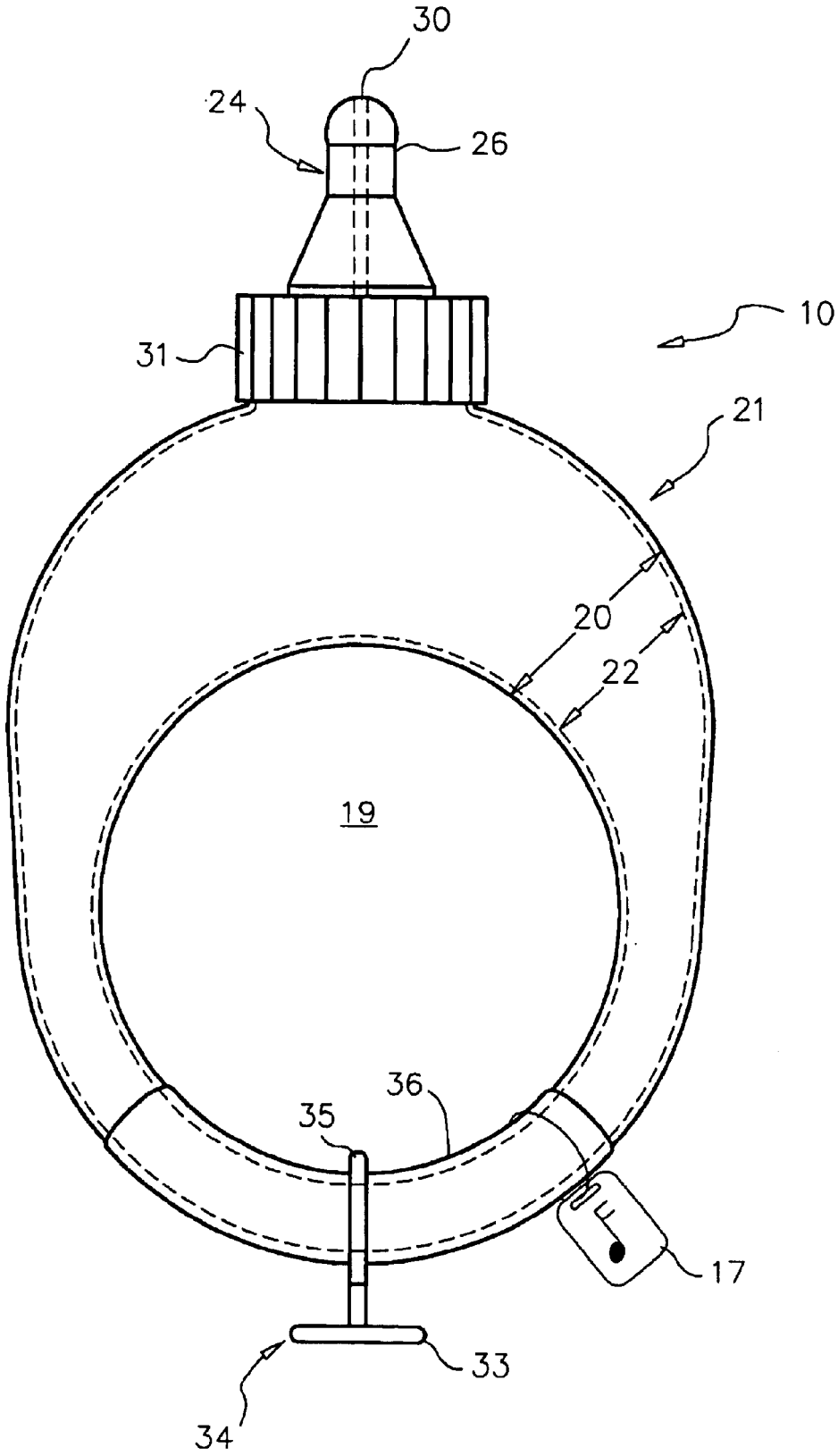
FIG. 1B is a front view of a fluid dispenser as in the present invention.
Figure 1C:
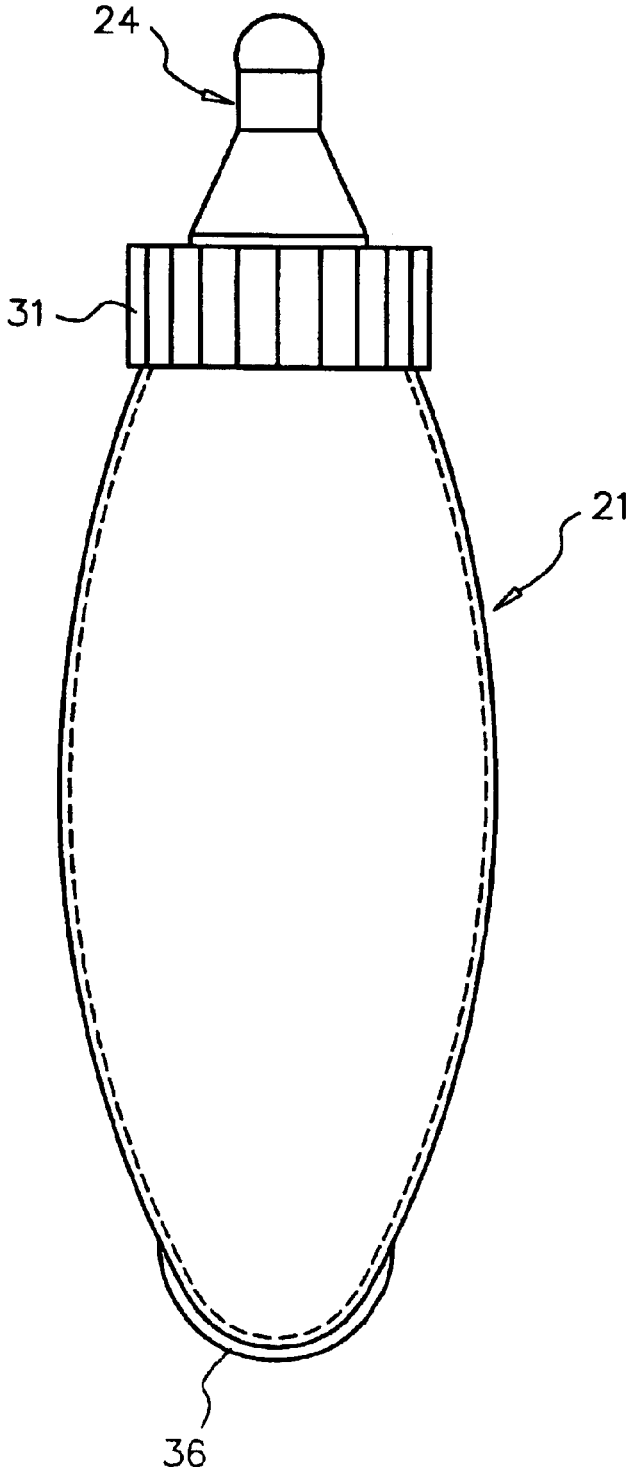
FIG. 1C is a side view of a fluid dispenser as in the present invention.

FIGS. 1A, 1B and 1C depict an embodiment according to the present invention. According to the embodiment shown, a dispenser 10 for feeding liquid to an infant with a generally circular continuous ring container 21 having an opening 32, outer diameter 20 and inner bore 22. The inner bore 22 being adapted for receiving a fluid. The nipple 24 may be formed of compressible material, the nipple having a flexible tubular body having a tip end 26 for insertion in an infant's mouth and a base end 28. The tip end 26 having a nipple opening 30 for flow of the liquid through the nipple 24 from the container 21 in response to the infant's sucking action on the tip end 26 and the base end 28 being a radially enlarged flange for attaching the nipple 24 to the protruding ring 29 of the container 21. A securing ring 31 is utilized to attach the nipple 24 to the opening 32 of the container 21. The opening 32 has an interior sidewall 25 and an exterior threaded sidewall 27. The securing ring 31 has an inner threaded portion (not shown) which engages the exterior threaded sidewall 27, with the base end 28 of the nipple 24 between the securing ring 31 and the protruding ring 29. This allows the nipple to be connected to the container 21 in such a manner as to prevent leakage between the container 21 and the nipple 24. The securing ring 31 may be fixedly, permanently attached, with liquids pre-filled in the inner bore 22 so as to provide a disposable dispenser for feeding liquids to an infant. This may include water, pre-mixed formula, soft foods, liquid foods, juices or any other liquid or food intended for infants, babies, children or other consumers (such as handicapped or elderly individuals requiring assistance). There may also be a seal 15 between the securing ring 31 and the container 21. According to a preferred embodiment, the container 21 may be made of a polycarbonate plastic. These bottles are clear, shatter-resistant, lightweight and cost effective. Other materials may be glass, non-polycarbonate (opaque) plastic, and disposable plastic bottles. The container 21 may be rigid or semi flexible. There may also be a stand 34, with a u-shaped portion 35 and a flat bottom 33. The u-shaped portion 35 may be in communication the container. There may also be a reinforced portion 36 for the u-shaped 35 part of the stand to connect to and provide added stability. The reinforced portion 36 may also be used as a teether for the infant. This provides a dispenser for feeding liquids that may be placed near an infant to be played with and a child may lift the dispenser, thus stimulating strength, dexterity and independence of a small child or infant. This develops not only the infant's gross motor skills, but also aids fine motor skill development. However, when the dispenser is not being used, the dispenser may be placed in an upright position for drinking and ease of placement. Optionally, a musical attachment 17 may be attached to the container 21. This may be any musical attachment as known within the art. Musical attachments are known within the art. By way of example, U.S. Pat. No. 4,678,093 provides a good summary of musical baby bottles. The present invention envisions a microchip having musical information encoded therein, a speaker electrically connected to the microchip, a battery electrically connected to the microchip and a switch electrically connected to the microchip.

FIG. 1B depicts the nipple 24 attached to the dispenser 10 for feeding liquid to an infant. As shown the securing ring 31 allows for the attachment of the nipple 24 to the container 21. The radially enlarged flange allows for a tight seal so as to avoid leakage. The tip end 26 having a nipple opening 30 for flow of the liquid through the nipple 24 from the container 21 in response to the infant's sucking. The opening 32 has an interior sidewall 25 and an exterior threaded sidewall 27. The securing ring 31 may be fixedly, permanently attached, with liquids pre-filled in the inner bore 22 so as to provide a disposable dispenser for feeding liquids to an infant. There may also be a seal (not shown) between the securing ring 31 and the container 21. The u-shaped portion 35 of the stand 34 is in communication with the reinforced portion 36. This provides a self-supporting dispenser for feeding liquids that may be placed near an infant to be played with and a child may lift the dispenser, thus stimulating strength, dexterity and independence of a small child or infant. When the dispenser is not being used, the dispenser may be placed in an upright position for drinking and ease of placement. FIG. 1C depicts a side view according to the present invention. As shown, the container 21 may be thinner at the reinforced portion 36. However, the container may be of any thickness or generally circular shape (including oval, ellipse, etc).

Figure 2A:
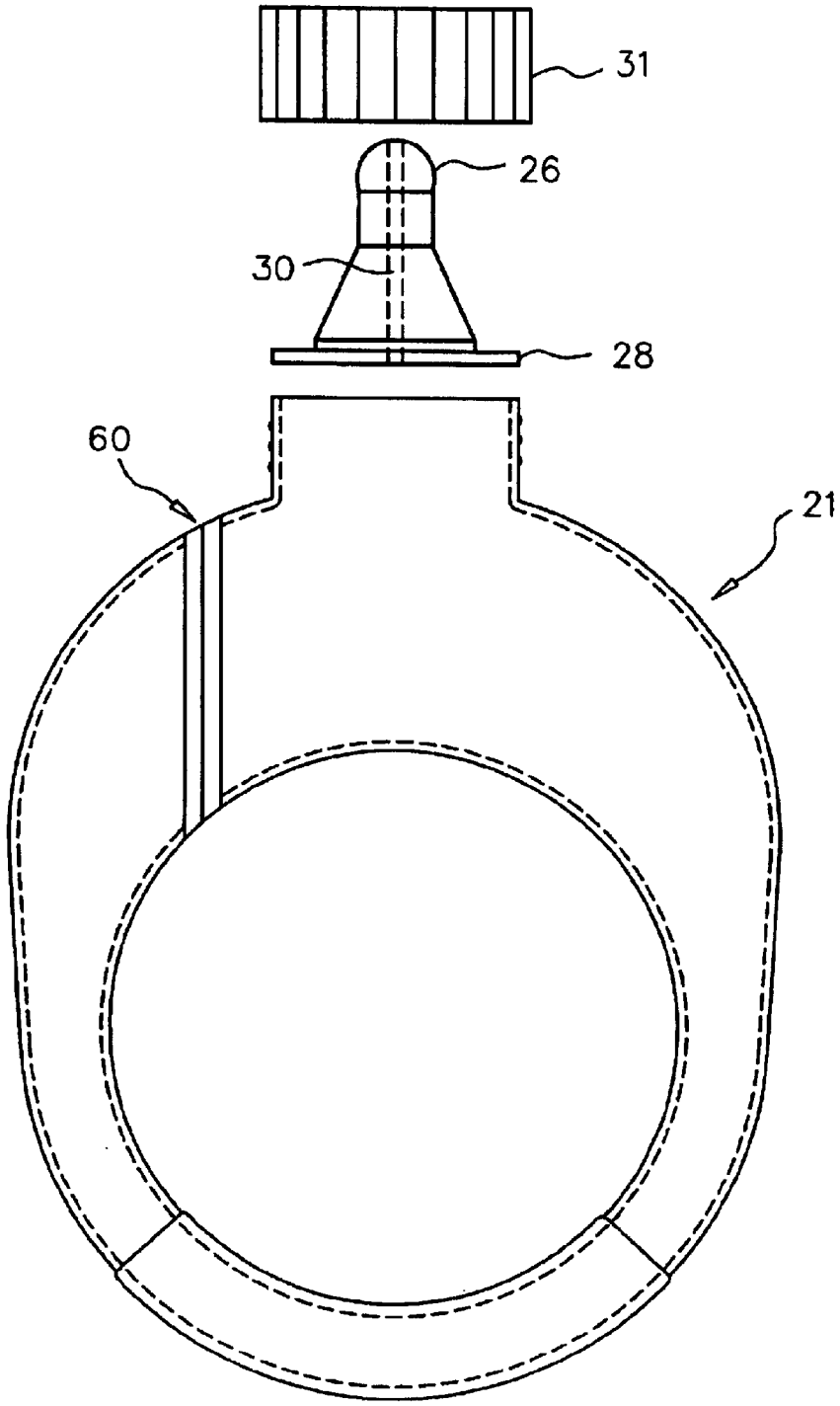
FIG. 2A is a front view of a closed fluid dispenser as in the present invention.
Figure 2B:
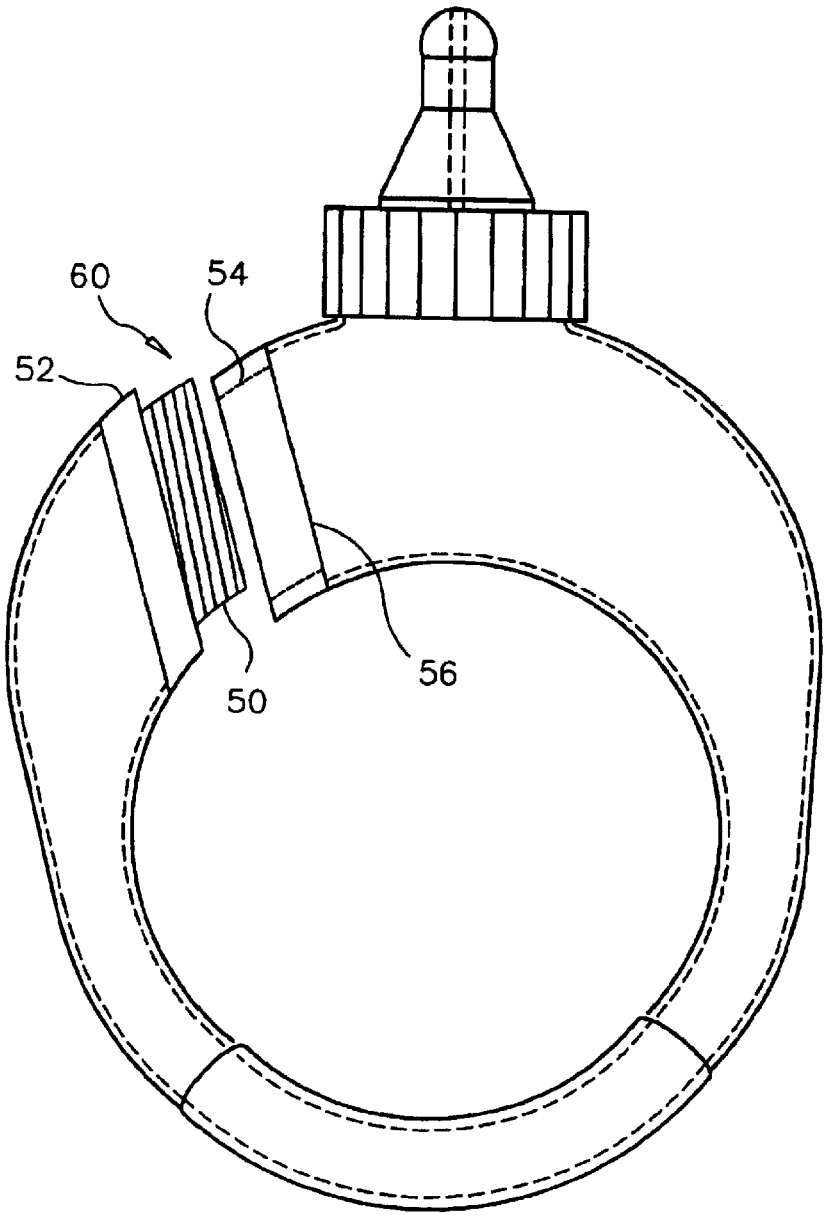
FIG. 2B is a front view of an open fluid dispenser as in the present invention.

FIGS. 2A–2B depict an alternate embodiment with a connector that allows for washing the inner bore 22. As shown, there may be a connector 60. The connector 60 may be comprised of a protruding end 50 and a recessed end 54. According to the embodiment shown, the protruding end 50 may be in communication with a first end 52 of the container 21. A recessed end 54 may be in communication with a second end 56. The protruding end 50 and recessed end 54 are each threaded. Either end or both ends may rotate so as to allow the recessed end 54 to connect to the protruding end 50, so as to form a connector 60. As shown in FIG. 2B, the connector 60 may be opened and water allowed to flow through the container 21 so as to clean the interior. According to the embodiment shown, the container should be made of a flexible material. This allows for a reusable, cleanable container for feeding liquids to infants.

Figure 3:
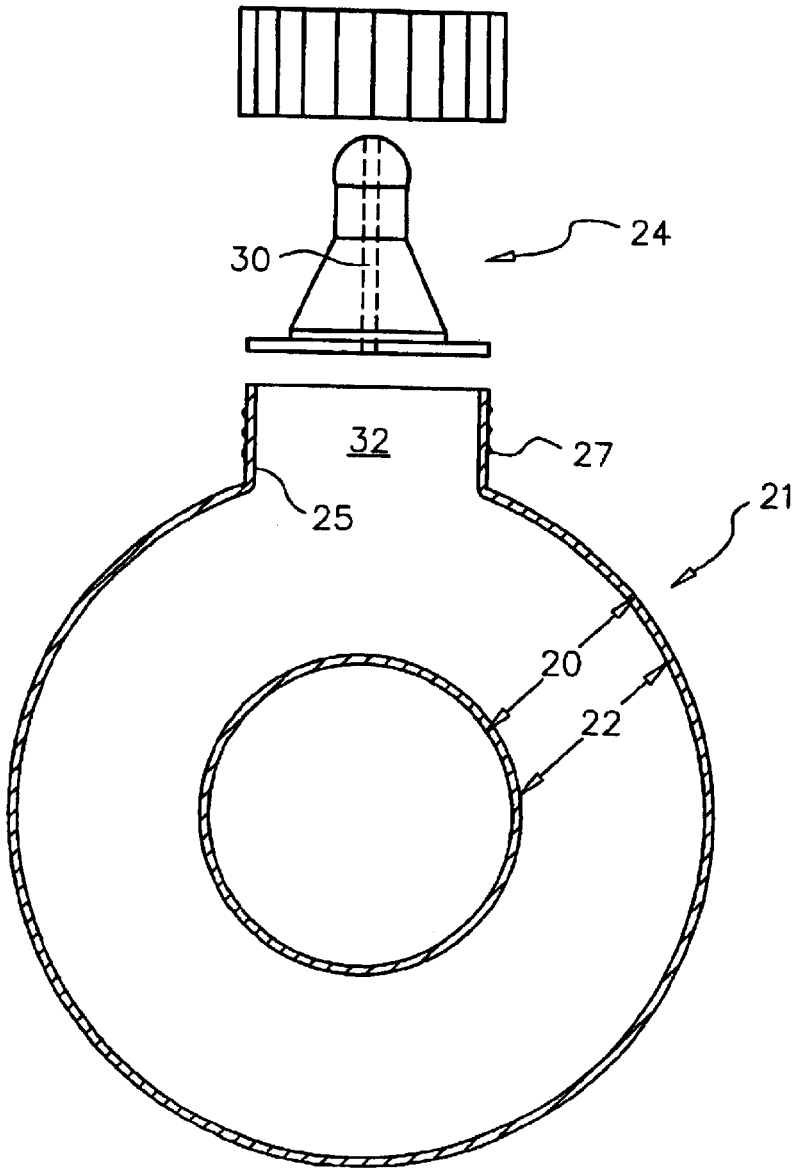
FIG. 3 is a front view of a fluid dispenser as in the present invention.

FIG. 3 depicts a disposable pre-filled liquid dispenser. As shown, there may be a dispenser 10 for feeding liquid to an infant with a generally circular continuous ring container 21 having an opening 32, outer diameter 20 and inner bore 22. The inner bore 22 being adapted for receiving a fluid. The nipple 24 may be formed of compressible material, the nipple having a flexible tubular body having a tip end 26 for insertion in an infant's mouth and a base end 28. The tip end 26 having a nipple opening 30 for flow of the liquid through the nipple 24 from the container 21 in response to the infant's sucking action on the tip end 26 and the base end 28 being a radially enlarged flange for attaching the nipple 24 to the opening of the container 21. A securing ring 31 is utilized to attach the nipple 24 to the opening 32 of the container 21. The opening 32 has an interior sidewall 25 and an exterior threaded sidewall 27. The securing ring 31 has an inner threaded portion (not shown) which engages the exterior threaded sidewall 27, with the base end 28 of the nipple 24 between the securing ring 31 and the exterior threaded sidewall 27. This allows the nipple to be connected to the container 21 in such a manner as to prevent leakage between the container 21 and the nipple 24. The securing ring 31 may be fixedly, permanently attached, with liquids pre-filled in the inner bore 22 so as to provide a disposable dispenser for feeding liquids to an infant. This may include water, pre-mixed formula, soft foods, liquid foods, juices or any other liquid or food intended for infants, babies, children or other consumers (such as handicapped or elderly individuals requiring assistance). There may also be a seal (not shown) between the securing ring 31 and the container 21. According to a preferred embodiment, the container 21 may be made of a polycarbonate plastic. The disposable embodiment as depicted does not have a stand or any reinforcement on the bottom portion, as it is a purpose of this embodiment to provide an inexpensive, disposable device utilizing the least amount of materials so as to also be recyclable. Because the bottle is pre-filled and disposable, there is no need to properly clean and sterilize baby bottles, bottle feeding nipples, and caps to prevent introduction of harmful contaminants into infant formula and other beverages to be consumed by the infant. This allows for the time consuming step of sterilization to be avoided and moreover, avoids the potential risk posed to the infant by failing to clean a reusable baby bottle thoroughly. Also, this prevents the problems associated with mixing formulas and other liquid which may subject the infant to gastric distress or nutritional imbalances. Infants are especially sensitive because their systems have not yet fully developed. Dilution water, and ordinary tap water in particular, may contain trace amounts of minerals or bacteria which are harmful to infants. By pre-filling the containers with highly purified liquids, especially intended for infant consumption, this problem may be avoided.

Figure 4A:
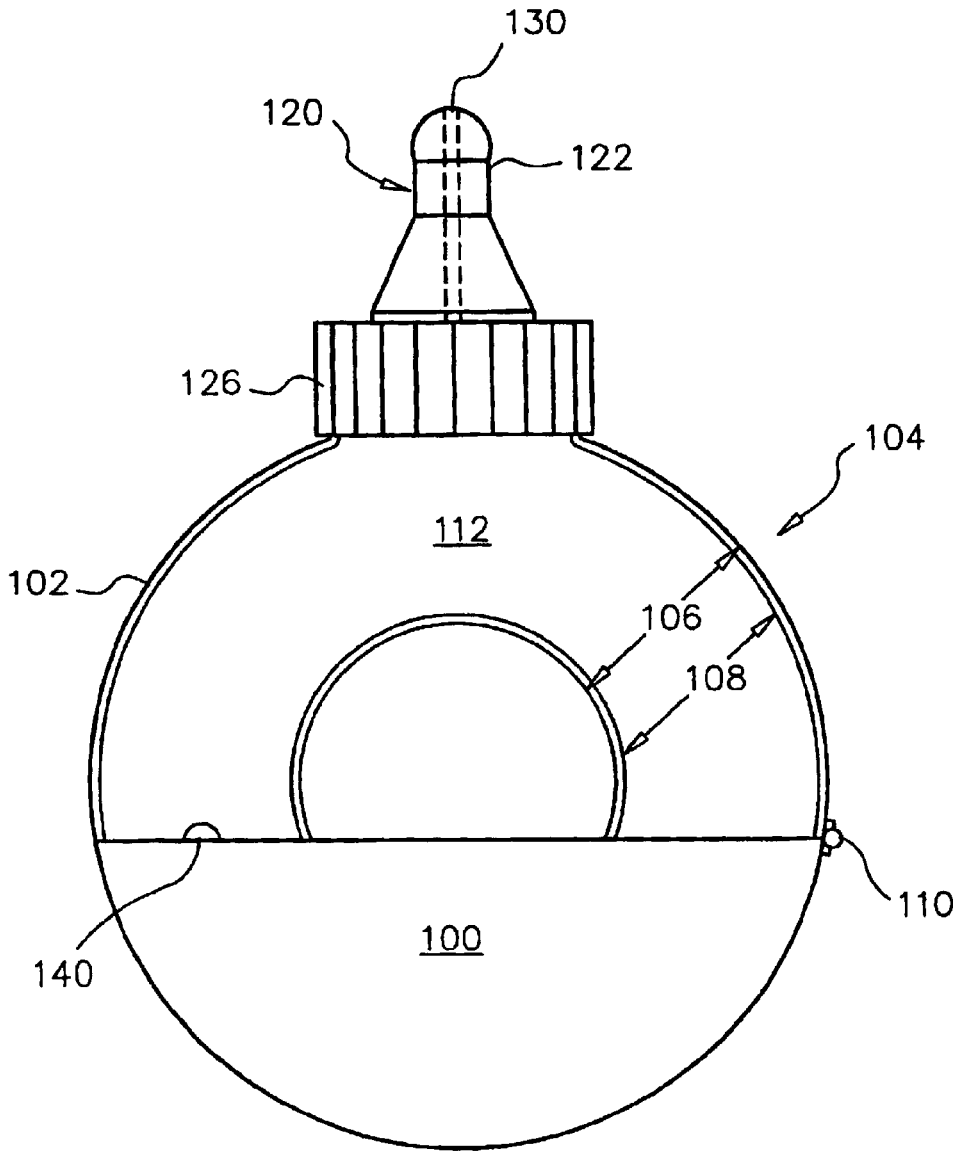
FIG. 4A is a front view of a closed self-supporting fluid dispenser as in the present invention.
Figure 4B:
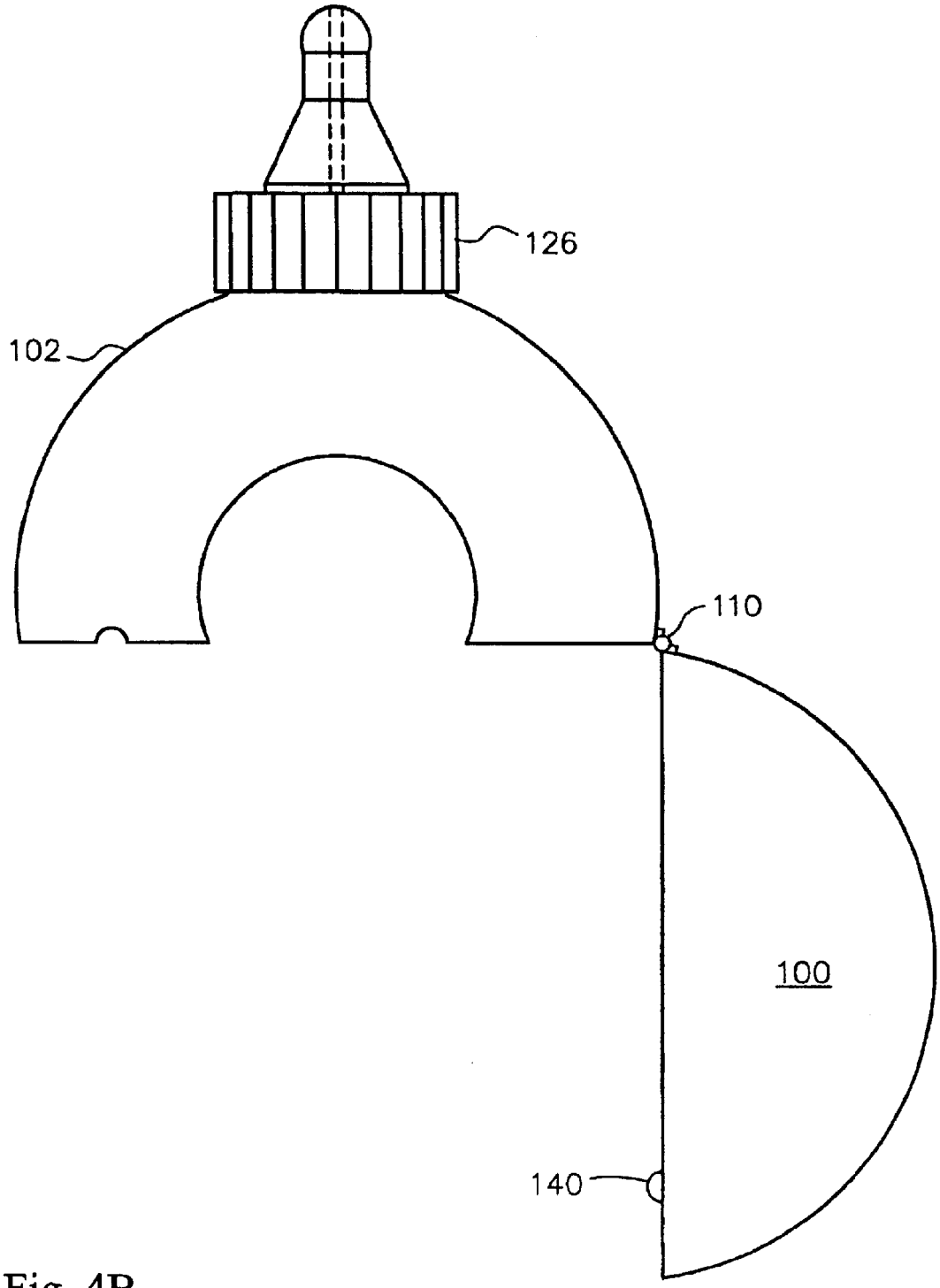
FIG. 4B is a front view of an open self-supporting fluid dispenser as in the present invention.

FIGS. 4A and 4B depict a self-supporting embodiment according to the present invention. As shown, there may be an outer housing comprised of a stand portion 100 and a liquid portion 102, wherein the outer housing 104 has a generally circular continuous ring shape when closed (as shown in FIG. 4A) and the liquid portion 102 has an outer diameter 106 and an inner bore 108 for containing food or beverage to be dispensed. As in the previous embodiments, there may be an opening 112 formed in a portion of the liquid portion 102 and continuing through the inner bore 108. The opening 112 is formed by a protruding ring having an interior sidewall and an exterior threaded sidewall; a nipple 120 formed of compressible material, the nipple 120 comprising a flexible tubular body having a tip end 122 for insertion in the infant's mouth and a base end, the tip end 122 having a nipple opening 130 for flow of the liquid through the nipple 120 from the liquid portion 102 in response to the infant's sucking action on the tip end 122; and a generally circular securing ring 126 with an outer diameter and an inner threaded diameter (not visible), wherein the inner threaded diameter is in communication with an exterior threaded sidewall (not visible).

As shown in FIG. 4B, the stand portion 100 may be hingedly attached, by a hinge 110, to the liquid portion 102 so as to provide a self-supporting combination pacifier, teether and refillable baby bottle when in an open position. A connecting device, such as clasp 140, may be utilized to secure the stand portion 100 in a closed position when desired to be used as a teether or pacifier. The connecting device may be any means known within the art to attach a first item to a second item.

It is also envisioned that a number of attachments may be added to any of the previously mentioned embodiments including musical and vibratory devices and the like. It is envisioned that such attachments may be attached to a portion along the outer diameter 20. The present invention represents a significant advancement in the art, providing an apparatus that allows for teething, dispensing liquids and developing motor skills of infants. At the same time, providing a toy like dispenser that soothes the child and may calm them, preventing crying. Also, the disposable embodiment accomplishes these goals, while being ideal for traveling, providing sanitary, pre-mixed juices and formulas.

It should be understood, of course, that the foregoing relates to preferred embodiments of the invention and that modifications may be made without departing from the spirit and scope of the invention as set forth in the following claims.

I claim:

1. A self-supporting combination pacifier, teether and refillable baby bottle for feeding liquid to a nursing infant, comprising:

an outer housing comprised of a stand portion and a liquid portion, wherein said outer housing has a generally circular continuous ring shape when closed and said liquid portion having an outer diameter and an inner bore for containing food or beverage to be dispensed and wherein said stand portion is hingedly attached to said liquid portion so as to provide a self-supporting combination pacifier, teether and refillable baby bottle when in an open position;

an opening formed in a portion of said liquid portion and continuing through said inner bore, wherein said opening is formed by a protruding ring having an interior sidewall and an exterior threaded sidewall;

a nipple formed of compressible material, said nipple comprising a flexible tubular body having a tip end for insertion in the infant's mouth and a base end, said tip end having a nipple opening for flow of the liquid through said nipple from said liquid portion in response to the infant's sucking action on said tip end; and a generally circular securing ring with an outer diameter and an inner threaded diameter, wherein said inner threaded diameter is in communication with said exterior threaded sidewall.

* * * * *